United States Patent [19]

Pauli

[11] 4,109,221

[45] Aug. 22, 1978

[54] RETAINING MEANS FOR A SOLENOID ASSEMBLY

[75] Inventor: Jude A. Pauli, Florissant, Mo.

[73] Assignee: Emerson Electric Co., St. Louis, Mo.

[21] Appl. No.: 748,830

[22] Filed: Dec. 9, 1976

[51] Int. Cl.[2] ..... H01F 3/00

[52] U.S. Cl. ..... 335/251; 335/255

[58] Field of Search ..... 335/251, 281, 243, 249, 335/255, 99, 104, 248, 240, 252; 339/12, 176, 191

[56] References Cited

U.S. PATENT DOCUMENTS 2,605,327 7/1952 Ranson ..... 335/240

3,896,405 7/1975 Pauli ..... 335/281

*Primary Examiner*—Harold Broome

*Attorney, Agent, or Firm*—Polster, Polster and Lucchesi

[57] ABSTRACT

A solenoid valve having a core tube and a top plug in the outer end of the core tube, is provided with an integrally formed, closed top wall and fastening means for preventing movement of a solenoid coil. The fastening means is mounted to the top wall and projects outwardly axially therefrom. In the preferred embodiment, the fastening means has an outer wall formed in a screw thread. A nut with a complementary internal thread is screwed down on the thread of the fastening means to hold the solenoid coil in place.

7 Claims, 6 Drawing Figures

RETAINING MEANS FOR A SOLENOID ASSEMBLY

BACKGROUND OF THE INVENTION

It is common in the solenoid valve art to provide a core tube of stainless steel or other like non-magnetic material around which a solenoid coil is mounted, and to mount a top plug or fixed armature part in the outer end of the core tube. The art is replete with examples of devices intended to hold a solenoid coil in place, in conjunction with the core tube construction.

In general, the core tubes are constructed either with a closed outer end, by a wall integral with the side wall of the core tube, or by a solid top plug, inserted in an opening along the outer end of the core tube. In the core tube without an integral top wall, the top plug usually is arranged to receive a screw, or is provided with an upwardly projecting threaded stud to take a nut, by which screw or nut the solenoid coil or housing is mounted against movement in the lengthwise direction of the core tube. In the closed ended tube, the core tube itself is grooved to receive a snap ring, or was threaded, as for example, in the to Pauli, U.S. Pat. No. 3,896,405, to receive a complementary threaded fastener. When the core tube is open ended, a leak path potentially exists from the axially inner portion of the core tube toward the outer end thereof. The potential for leakage along the core tube is undesirable in some applications of solenoid valves. The closed ended core tube constructions, while working for their intended purposes, often require time consuming constructional operations which raise overall product cost. To my knowledge, prior to my invention, no one has provided a core tube having an integral top wall with independent fastening means, thereby attaining simple, low cost core tube construction, non-leak path design and solenoid coil movement prevention.

One of the objects of this invention is to provide a solenoid valve structure in which the solenoid coil or housing can be mounted tightly in spite of substantial variation and height of the coil, the core tube, or the housing.

Another object of this invention is to provide such a structure which is easy to produce, economical, and rugged.

Another object of this invention is to provide a core tube having an integral top wall closing the outer end of the core tube with fastening means projecting axially outwardly of the outer end of the tube.

Other objects of this invention will be apparent to those skilled in the art in light of the following description and accompanying drawings.

SUMMARY OF THE INVENTION

In accordance with this invention, generally stated, a solenoid valve having a core tube mounted on a valve body and a solenoid coil mounted on the core tube intermediate the ends thereof, the core tube having a plug in its outer end, is provided with an integrally formed top wall closing the outer end of the core tube. Fastening means is attached to the top wall and projects along the centerline axis of the core tube. Preferably, the fastening means has an outer wall having a screw thread formed in it, which is designed to receive a nut having a complementary thread for retaining the solenoid coil or a solenoid coil housing on the core tube and fastened tightly between the nut and the valve body.

Alternatively, the fastening means may be a snap nut which receives a post projecting from the top wall of the core tube.

DESCRIPTION OF THE PREFERRED EMBODIMENT

Figure 1:
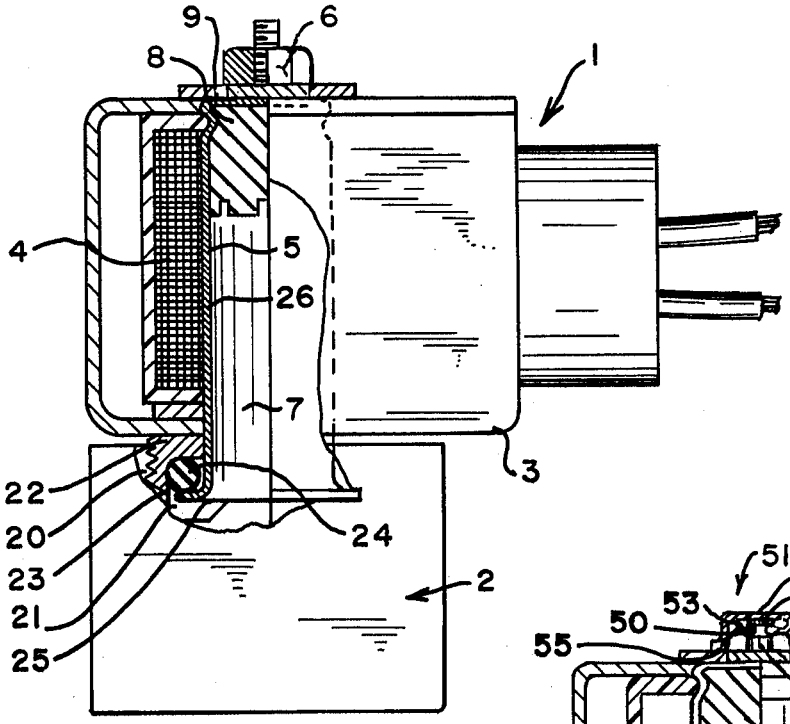
FIG. 1 is a view in side elevation, partly broken away, and partly in section, of a solenoid valve with a core tube of this invention.

Referring now to FIGS. 1 through 4 of the drawings for one illustrative embodiment of solenoid valve of this invention, reference numeral 1 indicates a completed solenoid valve assembly which includes a valve body 2, a solenoid housing 3, a solenoid coil 4 within the housing 3, a core tube 5 and a retaining nut 6. The valve body 2 has an internally threaded opening 20 with a stepped shoulder 21. An externally threaded keeper 22 with an annular seat 23 in which an O-ring 24 is engaged, is screwed into the threaded opening 20, to mount an outwardly flared flange 25 of an inner open end of the core tube 5, against a radial surface of the shoulder 21 in a conventional manner. The flange 25 is integral with a cylindrical side wall 26 of the core tube 5.

A conventional moving armature part 7 slidably mounted in the core tube 5, and a fixed armature part or top plug 8 is immovably mounted in the core tube 5 against an inside surface of a closed outer end wall 9 of the core tube. The end wall or top wall 9 is integral with the side wall 26 of the core tube 5.

The top plug 8 is cylindrical, with a flat top surface 30 perpendicular to the long axis of the cylindrical plug, a flat bottom surface 31 which, in this embodiment, holds a conventional shading ring 28, and a side surface 32, generally uninterrupted along the axial length of the plug 8. The plug 8 has a groove 11 formed in it. The core tube 5 has a corresponding groove 12 formed in it, which mates with a groove 11 to hold the plug 8 in position.

As indicated, the end wall 9 is integrally formed with the side wall 26 of the core tube 5. This is an important consideration in operation of the valve assembly 1 in that no fluid flow path exists through the core tube 5. A fastening means 40 is mounted to the end wall 9 to permit the clamping of solenoid coil and solenoid housing against the keeper 22. Those skilled in the art will recognize that some solenoid valve devices eliminate the housing shown and described in FIGS. 1 through 4, in which case the solenoid coil itself is clamped in position through use of the fastening means 40. The fastening means 40 includes a base 41 and a member or stud 42, projecting outwardly of the plane of the top wall 9, along or parallel to the longitudinal axis of the core tube 5. The member 42 has a threaded surface 43 extending along approximately its entire length. The fastening means 40 is mounted to the end wall 9 by any convenient method. Percussion welding works well, for example. The nut or fastener 6 has complementary threads formed along a central opening in the nut 6, permitting the nut 6 to clamp the solenoid housing 3 and solenoid coil 4 against the keeper 22.

Figure 5:
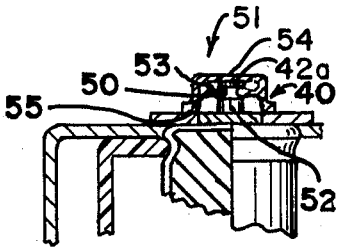
FIG. 5 is a view in side elevation of a second illustrative embodiment of core tube of this invention.
Figure 6:
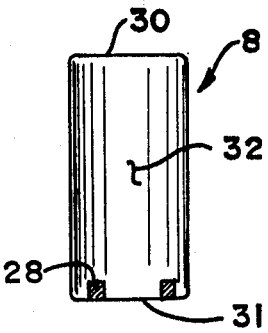
FIG. 6 is a view in side elevation of a top plug compatible with the core tube of this invention.
Figure 2:
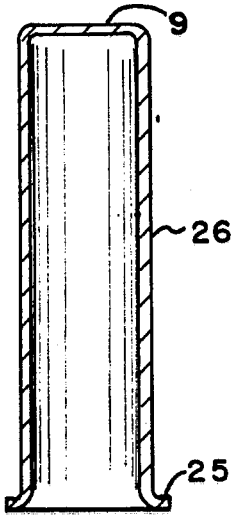
FIG. 2 is a longitudinal sectional view of one illustrative embodiment of core tube of this invention before its final assembly.
Figure 3:
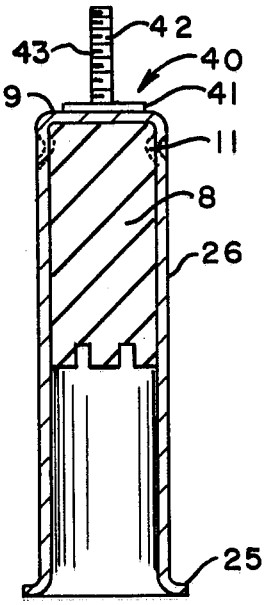
FIG. 3 is a view in side elevation of the core tube of FIG. 2, with fastening means attached thereto.
Figure 4:
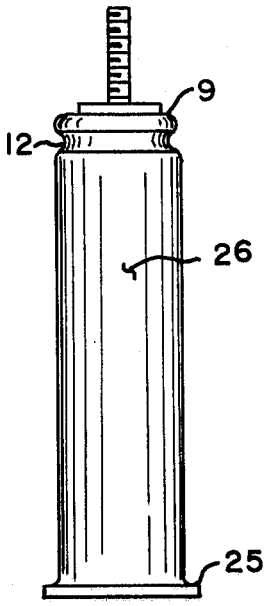
FIG. 4 is a view in side elevation of a final assembly for one illustrative embodiment of core tube of this invention.

Numerous variations, in the construction of the solenoid valve of this invention within the scope of the appended claims, will occur to those skilled in the art in light of the foregoing disclosure. Thus, the design silhouette of the valve may vary in other embodiments of this invention. The axial length of the fastening means 40 and its physical location with relationship to the end wall 9 may be changed. Different kinds of nuts can be used, such as elastic lock nuts or speed nuts, spring or lock washers can be employed and the nuts can take shapes and sizes different from the one illustrated. Other forms of fastening means may be employed. For example, in FIG. 5, a stud 42*a* of the fastening means 40 has a single groove 50 formed in it. A retainer 51 is mounted over the stud 42*a* and snapped into place to clamp the housing and coil against movement. Retainer 51 has an opening 52 in it, which is sized to receive the base 41 in a friction fit in the intermounted position of the retainer. A locking part 53 is sized for reception with the groove 50. A top 54 of the retainer 51 is designed to abut the end of the stud 42*a*, while a bottom wall 55 forces the housing and coil against the keeper 22 in a manner similar to that previously described. Although a specific order of part assembly is shown in the drawings, other constructional sequences may be used. For example, the fastening means 40 may be attached to the top wall 9 either before or after placement of the top plug 8. These variations are merely illustrative.

Having thus described the invention, what is claimed and desired to be secured by Letters Patent is:

1. In a solenoid valve having a one piece core tube, a top plug in an outer end of said core tube, said core tube having a thin cylindrical side wall, and an integrally formed, continuous, thin top wall, the improvement comprising fastening means mounted to said top wall without penetrating through said top wall, said fastening means having a member extending outwardly from said top wall, said member having means for engaging a fastener formed in it, said fastening means being welded to said core tube and extending outwardly from the closed end thereof, and a fastener intermounted with said fastening means.

2. The improvement of claim 1 wherein said top wall is circular, said fastening means being located along the longitudinal axis of said core tube.

3. The improvement of claim 2 wherein said core tube has a side surface, said side surface having a groove formed in it near said top wall.

4. The improvement of claim 1 wherein said fastening means includes a base mounted to said top wall, said member being attached to said base.

5. The improvement of claim 4 wherein said member is threaded along its outer surface, said fastener comprising a nut having a complementary threaded opening formed in it.

6. The improvement of claim 4 wherein said member has a groove formed in it, said fastener comprising a retainer engagable with said groove and intermountable with said fastening means.

7. In a solenoid valve having a core tube and a top plug in an outer end of said core tube, said core tube having a thin cylindrical side wall, and a one piece, continuous, thin top wall integrally formed with said side wall, the improvement comprising fastening means mounted to said top wall without penetrating through said top wall, said fastening means extending outwardly from said top wall, said fastening means including a stud at least parallel to a lengthwise axis of said core tube, said stud being formed to receive a fastener, and a fastener intermountable with said stud.

* * * * *